US008113102B2

(12) United States Patent
Magnan et al.

(10) Patent No.: US 8,113,102 B2
(45) Date of Patent: Feb. 14, 2012

(54) PROGRAMMING PROCESS FOR THE FUSE OF A PROJECTILE AND PROGRAMMING DEVICE ENABLING THE IMPLEMENTATION OF SUCH PROCESS

(75) Inventors: Pierre Magnan, Saint Palais (FR); Olivier Tribalat, Cosne sur Loire (FR)

(73) Assignee: Nexter Munitions, Versailles (FR)

( * ) Notice: Subject to any disclaimer, the term of this patent is extended or adjusted under 35 U.S.C. 154(b) by 78 days.

(21) Appl. No.: 12/591,351

(22) Filed: Nov. 17, 2009

(65) Prior Publication Data

US 2010/0147141 A1 Jun. 17, 2010

(30) Foreign Application Priority Data

Nov. 18, 2008 (FR) ..... 08 06484

(51) Int. Cl.
*F42C 17/00* (2006.01)

(52) U.S. Cl. ..... 89/6.5; 89/6

(58) Field of Classification Search ..... 89/6.5, 89/6, 1.814; 102/207, 270
See application file for complete search history.

(56) References Cited

U.S. PATENT DOCUMENTS

| | | | | |
|---|---|---|---|---|
| 4,022,102 | A * | 5/1977 | Ettel | 89/6.5 |
| 4,080,869 | A * | 3/1978 | Karayannis et al. | 89/6.5 |
| 4,300,452 | A * | 11/1981 | Beuchat et al. | 102/270 |
| 4,318,342 | A * | 3/1982 | Chandler | 102/207 |
| 5,117,733 | A | 6/1992 | Fischer et al. | |
| 5,160,801 | A * | 11/1992 | Andersen et al. | 89/6 |
| 5,343,795 | A | 9/1994 | Ziemba et al. | |
| 5,787,785 | A * | 8/1998 | Muenzel et al. | 89/6.5 |
| 6,176,168 | B1 * | 1/2001 | Keil et al. | 89/6.5 |
| 6,439,097 | B1 * | 8/2002 | Loving | 89/1.814 |
| 6,557,450 | B1 * | 5/2003 | Cox et al. | 89/6.5 |
| 6,666,123 | B1 * | 12/2003 | Adams et al. | 89/6.5 |
| 7,077,045 | B2 * | 7/2006 | Dietrich et al. | 89/6 |
| 7,926,402 | B2 * | 4/2011 | Pikus et al. | 89/6.5 |
| 2005/0126379 | A1 * | 6/2005 | Pikus et al. | 89/6 |
| 2010/0147141 | A1 * | 6/2010 | Magnan et al. | 89/6.5 |

FOREIGN PATENT DOCUMENTS

| | | |
|---|---|---|
| EP | 1 757 894 A1 | 2/2007 |
| GB | 2 350 937 B | 8/2003 |

OTHER PUBLICATIONS

French Search Report issued in French Patent Application No. 08.06484 on Jul. 28, 2009. (English Translation attached).

* cited by examiner

*Primary Examiner* — Michelle Clement
(74) *Attorney, Agent, or Firm* — Oliff & Berridge, PLC

(57) ABSTRACT

The invention relates to a programming process and device for a fuse of a projectile using a programming coil transmitting by induction a programming signal to reception means integral with the fuse. This process is characterized in that the programming signal is transmitted from at least one second programming coil that is separate from the first one, each coil being linked individually to electronic control means and the two coils being arranged so as to be able to lie in proximity to the fuse of the projectile when the latter passes in the feed means of the weapon, the coils being arranged such that the projectile fuse passes successively in front of each coil, particularly adapted to the programming of medium caliber projectiles.

7 Claims, 7 Drawing Sheets

PROGRAMMING PROCESS FOR THE FUSE OF A PROJECTILE AND PROGRAMMING DEVICE ENABLING THE IMPLEMENTATION OF SUCH PROCESS

BACKGROUND OF THE INVENTION

1. Field of the Invention

The technical scope of the invention is that of processes and devices enabling the programming of a projectile fuse.

A fuse is an electronic or electromechanical device that controls the firing of the explosive loaded in the projectile.

2. Description of the Related Art

The fuses may be of the timer or proximity type or else may control the functioning on impact on the target. They are sometimes multi-mode and thus enable the projectile to be made to function on impact or with a timer, depending on the user's requirements.

Multi-mode or timer fuses must be programmed before firing. Programming means, for example, choosing the mode of functioning (multi-mode fuse) and/or the time lapse between the firing and the detonation (timer data).

Today, more often than not, programming is made in the fuse by induction by means of programming coils.

Patent GB2350937 describes, for example, a programming device for the fuse of a projectile that uses a single mobile programming coil that is L-shaped (so as to increase the efficiency of the coupling between the projectile fuse and the programming coil). U.S. Pat. No. 5,117,733 describes another example of an induction coil that ensures the programming of medium caliber projectile fuses in the feed chutes of a weapon.

This device comprises two coils: one coil to detect the approach of a projectile and one coil to programme the fuse. When the first coil detects a projectile, the second coil is activated and it emits a programming signal intended for the fuse.

Such a device also implements a single programming coil that has a profile selected such that part of the coil is still opposite the fuse during part of the forward movement of the projectile in the weapon feed chute. The programming performed is thus made more reliable since the signal is transmitted for a longer time during the course of the projectile.

Such a solution is, however, disadvantageous from an industrial perspective. The energy level implemented by this single coil requires control electronics to be defined that are overdimensioned with respect to requirements. Such electronics are difficult to integrate in a turret or in proximity to the programming coil.

Furthermore, the electromagnetic losses in the weapon structure and the induced radiation are too high.

SUMMARY OF THE INVENTION

The aim of the invention is to propose a programming process for a fuse that always ensures the transmission of a programming signal for a substantial duration but which, however, enables electronics of more reasonable dimensions to be implemented. The process according to the invention also enables the programming that is given to a given projectile to be controlled whilst limiting the electromagnetic radiation generated.

Thus, the invention relates to a programming process for a projectile fuse using a programming coil transmitting a programming signal to reception means integral with the fuse, process wherein the programming signal is transmitted from at least one second programming coil that is separate from the first one, each coil being linked individually to electronic control means and the two coils being arranged so as to be able to lie in proximity to the projectile fuse when the latter passes in the feed means of the weapon, the coils being arranged such that the projectile fuse passes successively in front of each coil.

According to one characteristic of the invention, the programming signal is advantageously modulated in output according to the distance between the coil and fuse, the maximal output being delivered by a coil when it is close to the fuse.

More specifically, each coil may emit a programming signal between two instants: an emission start instant and an emission end instant, the start of the emission being made when the projectile is at a first minimal distance from said coil and the end of the emission being caused when the projectile moves away from the coil by a second minimal distance.

According to a first embodiment, each coil emits a continuous signal at a constant output between the emission start instant and the emission end instant.

According to a second embodiment, each coil emits a continuous signal at variable output, at least one coil emitting with an output that increases between the emission start instant and a median instant and that decreases between the median instant and the emission end instant.

The invention also relates to a programming device enabling this process to be implemented. This device is characterized in that it comprises at least two programming coils each linked individually to electronic control means, coils arranged so as to be able to lie in proximity to the projectile fuse when the projectile passes through the feed means of a weapon, the coils being arranged such that the projectile fuse passes successively in front of each coil.

The device may advantageously comprise means enabling the position of the fuse to be determined with respect to the coils as the projectile progresses.

These means enabling the position of the fuse to be determined with respect to the coils may comprise at least one position sensor coupled with at least one electronic control means.

The position sensor may also be coupled with means to determine the progression rate of the projectile.

According to a particular embodiment, the coils may be arranged at a cylindrical surface of the weapon surrounding a feed star wheel, the rate of progression being determined by the spin rate of the feed star wheel.

The means enabling the fuse to be located and/or the progression rate of the projectile to be determined may be constituted by at least a second position sensor linked to the electronic control means.

BRIEF DESCRIPTION OF THE DRAWINGS

The invention will become more apparent from the following description of the different embodiments, such description being made with reference to the appended drawings, in which.

DETAILED DESCRIPTION OF THE PREFERRED EMBODIMENTS

Figure 1:
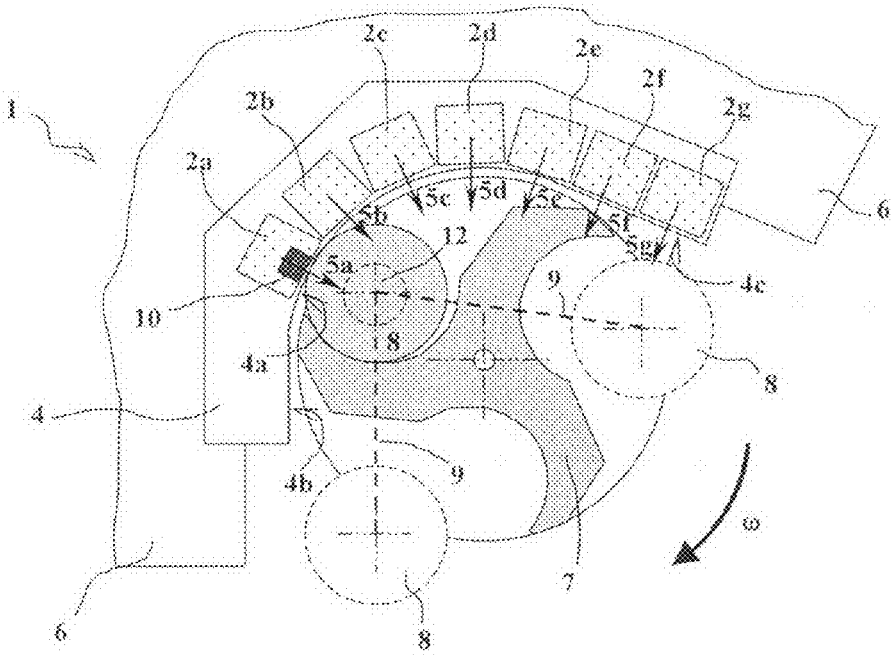
FIG. 1 is a schematic view of a programming device according to the invention put in place on a star wheel for an ammunition feed system for a weapon.
Figure 2:
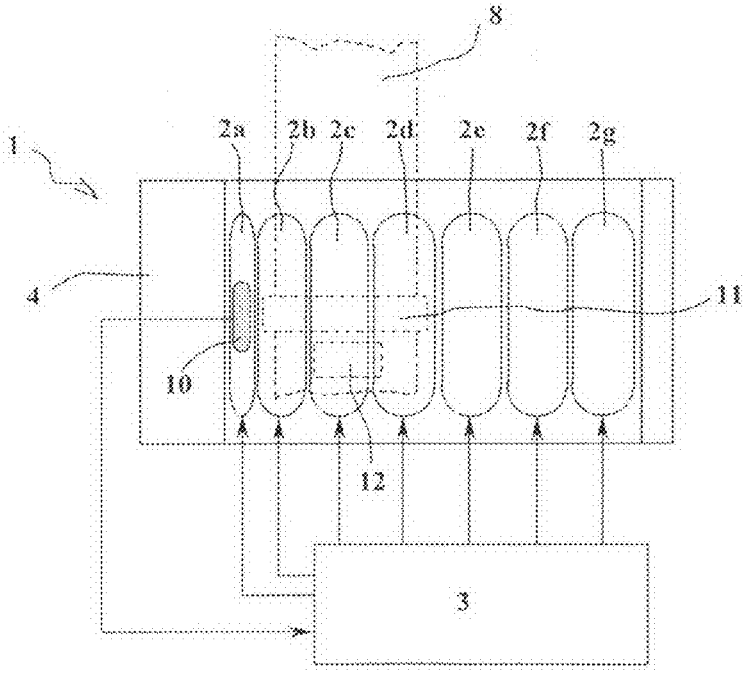
FIG. 2 is another schematic view of this device, the coils being shown from below.

With reference to FIGS. 1 and 2, a programming device 1 according to the invention comprises programming coils 2 that are all linked to electronic control means 3. The device here incorporates seven programming coils: 2*a*, 2*b*, 2*c*, 2*d*, 2*e*, 2*f*, and 2*g*. These coils 2 are each constituted by one or several windings of wire around a ferromagnetic core (not shown) and they each generate a field in a direction that is marked by arrows 5 (5*a*, 5*b*, 5*c*, 5*d*, 5*e*, 5*f* and 5*g*) in FIG. 1.

The coils 2 are all parallel to one another and they are integral with a metallic support 4 that carries housings adapted to the shapes of the different coils.

The support 4 incorporates a partially cylindrical surface 4*a* extended by two planes 4*b* and 4*c*. The coils 2 are arranged so as to be flush with surfaces 4*a* and 4*c*. The support 4 is fixed on an ammunition feed organ 6 for a weapon (not shown). This support 4 partially covers a feed star wheel 7 for this feed organ.

Classically, and in a manner well known to the Expert, the projectiles 8 (fastened on their stubs) are introduced into the weapon using chain belts 9 and they progress into the weapon chamber driven by one or several star wheels 7.

The star wheels 7 turn (arrow w) to drive the projectiles 8. The support 4 of the coils 2 is designed such that its cylindrical surface 4*a* surrounds the feed star wheel 7. Thus, the projectiles 8 pass successively in front of the different coils 2 as they move through the feed organ 6 and their fuses are thus programmed.

Figure 9:
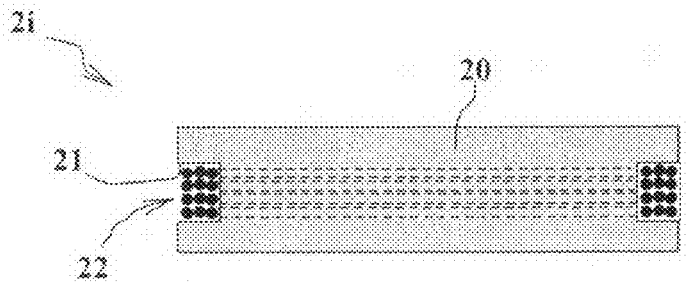
FIG. 9 is a view schematizing one embodiment of a coil implemented by the invention.

FIG. 1 schematically shows the fuse in the form of a circle 12 of dotted lines. The projectile 8, its drive belt 11 and its fuse 12 are also shown in dotted lines in FIG. 2. Here it is a base fuse position to the rear of the drive belt 11. FIG. 2 shows that the coils 2 are parallel to each other and their coil loops are substantially parallel to the axis of the projectile 8 (the schematic shapes of the coils given in FIG. 2 correspond to that of the coil loops). FIG. 9 schematizes more precisely such a coil with its loops parallel to the axis of the projectile. We see that this coil comprises a core of ferrite 20 incorporating a peripheral notch 21 in which the loops 22 are housed.

Whatever the type of fuse (nose or base), it is obvious that the support 4 for the coils 2 will be positioned in the weapon such that it is effectively near to the fuses of the projectiles in question.

Depending on the case, the support 4 may be positioned as here such as to be placed near to the projectile bases (base fuses).

For projectiles with nose fuses the support 4 will be positioned near to the projectile nose cones. It thus all depends on the type of ammunition being implemented.

The fuse classically incorporates reception means for the programming signal emitted by the coils. These means may incorporate a receiver coil (or antenna) coupled with decoding electronics for the signal transmitted. These means are not part of the present invention and will thus not be described here.

We observe, therefore, that each projectile fuse will pass successively in front of coils 2*a* to 2*g*. The programming signal will be transmitted to the fuse by the different coils 2*a* to 2*g* during the full time of passage of the fuse.

According to a first characteristic of the invention, the different coils are not linked in series by electronic control means 3 but are each linked individually to these control means 3.

Each coil may thus be powered by separate and specific means. Such means have reduced output characteristics (one seventh of the maximal output required to power all the coils) and are easier to define and to incorporate into a weapon system.

It is thus also possible for each coil to be powered individually. All the coils may be powered simultaneously but, according to a particular embodiment of the invention, it is also possible to avoid systematically powering all the coils with the current to ensure the programming of the fuse, thereby reducing the energy consumption and enabling the size of the coil power means to be further reduced.

According to another characteristic of the invention, the programming signal that will be emitted by each coil 2 will thus be modulated in output depending on the distance between the coil 2*i* in question and the projectile fuse 8.

It is, in fact, pointless to power coils 2*f* and 2*g* that are the furthest away when the projectile 8 is still located near to coils 2*a* and 2*b*.

In accordance with the invention, means are thus provided that enable the position of the fuse to be determined with respect to the coils 2*i* during the progression of the projectile 8.

These means here comprise a position sensor 10 that is linked to the electronic control means 3. The position sensor 10 may be formed by a loop supplied by a current that will detect the passage of the metallic mass of the projectile 8.

The sensor 10 is positioned at the first coil 2*a*. A housing merely needs to be provided in the loop of this coil 2*a* to put the detection loop 10 in place. It is also possible (according to a preferred embodiment) to implement an inductive sensor 10 rather than a loop.

The means enabling the position of the fuse with respect to the coils to be determined also comprises means to determine the progression rate of the projectile.

Indeed, to control the instant at which a coil is powered, it is necessary to know at which instant the fuse of a given projectile will be at a given distance from this coil.

With the embodiment described here, the progression rate is easy to determine since the spin rate $\omega$ of the star wheels is a constant value that depends on the weapon in question. This rate may thus be incorporated into a memory of the electronic control means 3. Alternatively, this rate may be measured.

Figure 3:
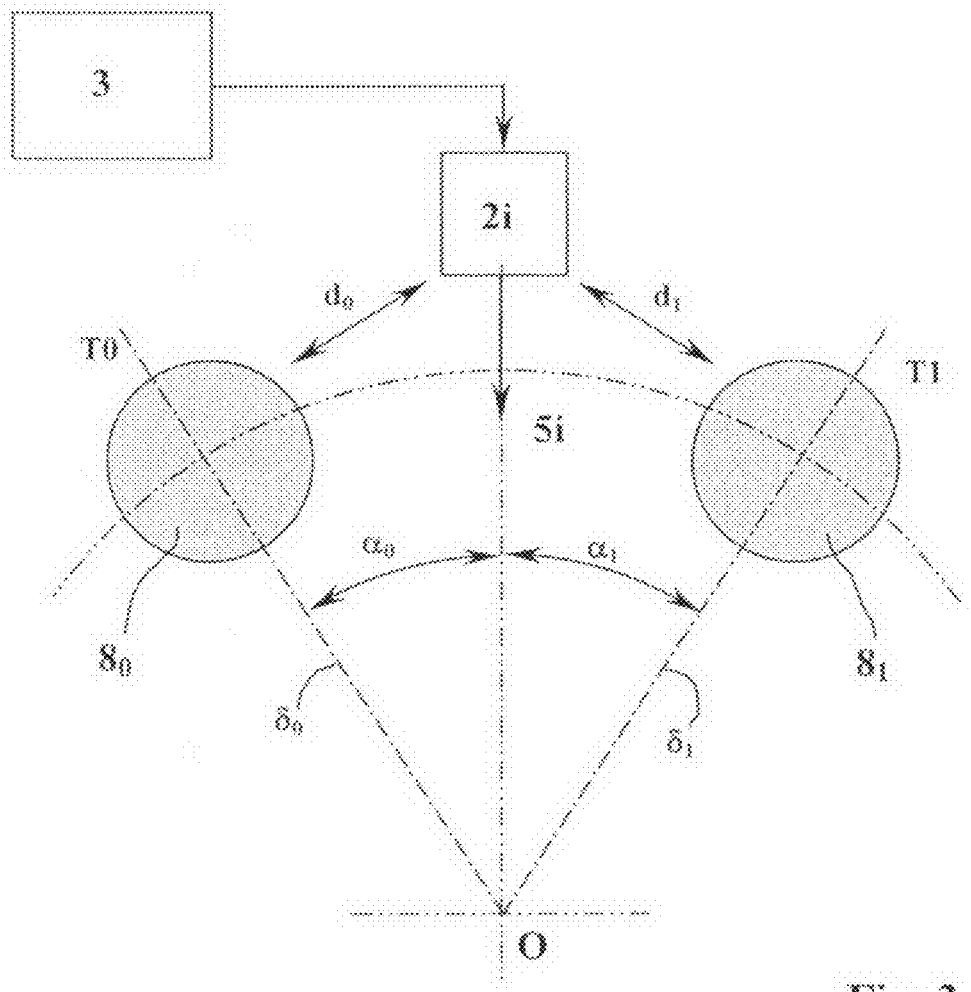
FIG. 3 shows a coil and two different positions occupied by a projectile, FIG. 4 schematizes control means according to one embodiment of the invention.

FIG. 3 shows a coil 2*i* and two different positions $\mathbf{8}_0$ and $\mathbf{8}_1$ occupied by a given projectile 8.

The projectile is at instant $T_0$ in position $\mathbf{8}_0$ and at instant $T_1$ in position $\mathbf{8}_1$.

According to the embodiment described here, the movement of the projectile is a circular translational motion controlled by the feed star 7.

In accordance with the invention, the coil 2*i* will only emit a programming signal between the emission start instant $T_0$ and the emission end instant $T_1$.

The start of the emission is controlled by the electronic control means 3 when the ammunition 8 is at a first minimal distance $d_0$ from the coil 2*i* (position $\mathbf{8}_0$). The end of the emission is then activated when the ammunition 8 moves away from the coil by a second minimal distance $d_1$ (position $\mathbf{8}_1$).

With a circular translational motion, we may advantageously take the first and second distances to be the angles $\alpha_0$ and $\alpha_1$ separating the main emission direction 5*i* of the coil 2*i* in question with the two extreme directions $\delta_0$ and $\delta_1$ that link the axis of the projectile 8 and the axis 0 of the star wheel 7 when the projectile is in the extreme positions $\mathbf{8}_0$ and $\mathbf{8}_1$ for the coil 2*i* in question.

The coil 2*i* emits only when the projectile is between position $\mathbf{8}_0$ and position $\mathbf{8}_1$. Maximal output is emitted therefore when the coil is close to the fuse of the projectile 8. No programming signals are emitted towards the projectile 8 before position $\mathbf{8}_0$ or after position $\mathbf{8}_1$.

Figure 4:
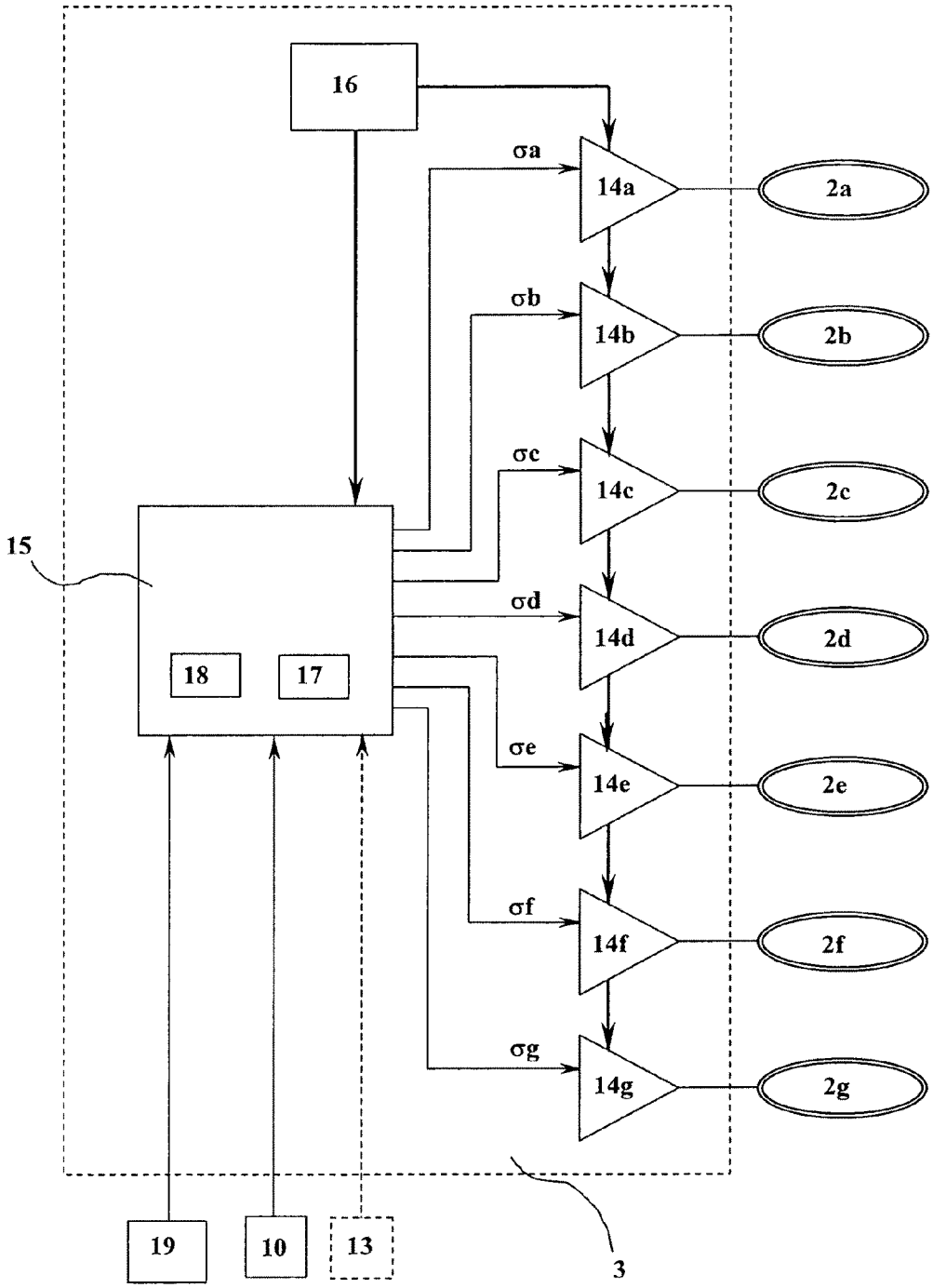

FIG. 4 schematizes control means 3 enabling such a control mode for the different coils.

These control means 3 comprise a power stage constituted by seven amplifiers 14*a* to 14*g* (one amplifier per coil 2) and a control stage 15 constituted by a programmable calculator, for example a pre-programmed component.

The control means 3 also comprise a power supply stage 16 (for example a battery) that supplies power for the different amplifiers 14*i* as well as for the control stage 15.

Classically, the control stage 15 incorporates a timer 17 and one or several memories 18. It furthermore receives the signals supplied by the position sensor 10 and is connected to a programming interface 19 (a keyboard, for example) by which a user introduces the required value or values to programme the fuses.

The control stage 15 will be able to pilot each amplifier 14*i* individually. Classically in the domain of audio amplifier control, piloting an amplifying stage will consist to applying to the latter a signal $\sigma_i$ of variable frequency and amplitude.

The variation in amplitude of each signal $\sigma_i$ will enable the amplitude of the amplifier output signal to be varied between a minimal value (zero) and a maximal value that is that maximal value foreseen by the dimensioning of the amplifier.

The variation in the frequency of each signal $\sigma_i$ will carry the required programming for the fuse. The latter will naturally incorporate a demodulation stage enabling the programmed received to be retrieved.

An algorithm memorized in the control stage 15 will enable the determination of which value to be given to each instant for each signal $\sigma_i$ as a function of the required programming given by the interface 19 and depending on the location of the projectile with respect to each coil, location that is determined thanks to the position sensor 10 and to the rate determination means (rate value memorized in the memory 18 or the measured value supplied by a specific sensor 13).

According to a first embodiment of the invention, each coil 2*i* will emit a continuous signal at a constant output between instant $T_0$ at the start of emission and instant $T_1$ at the end of emission.

Figure 5:
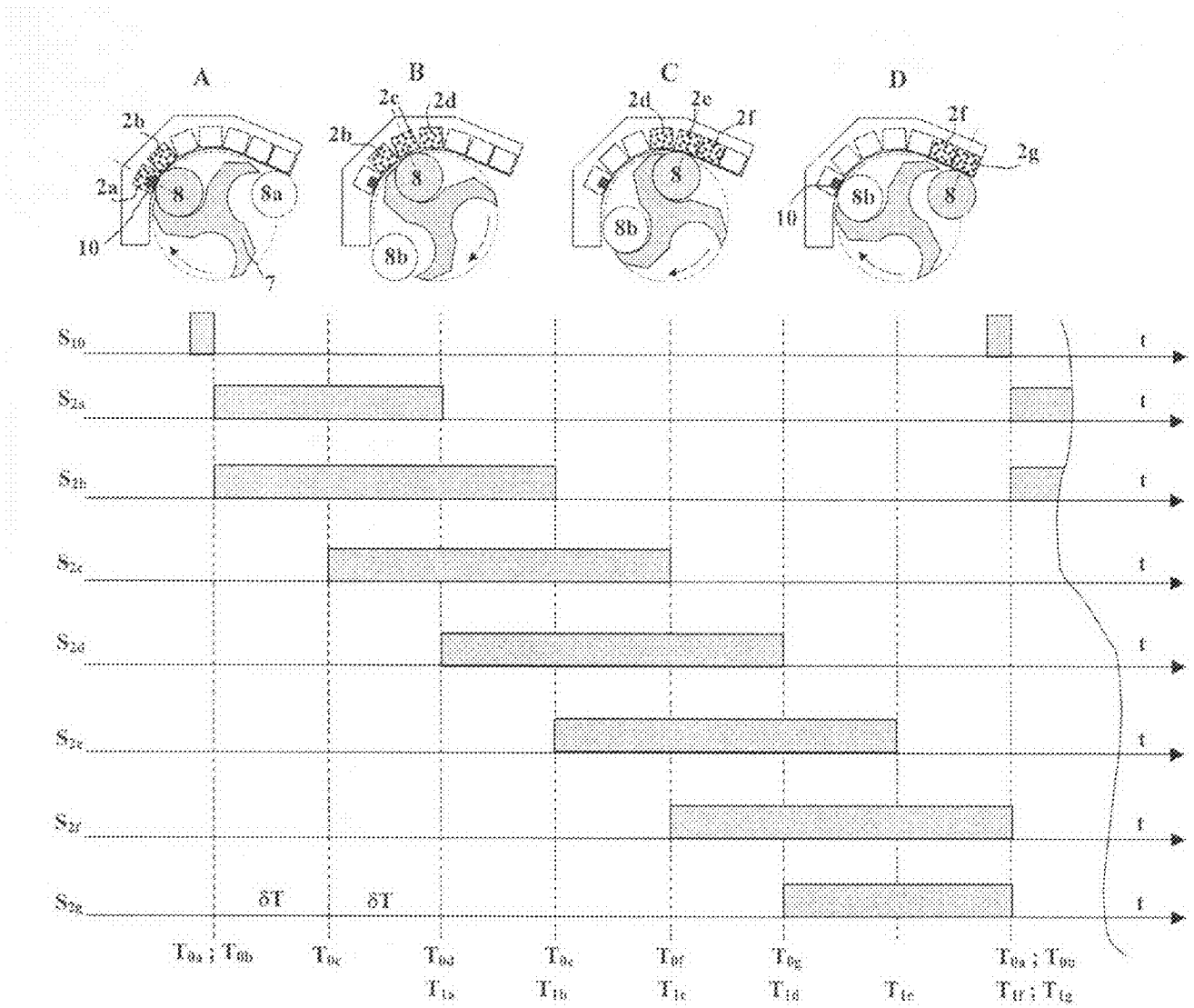
FIG. 5 is a diagram that shows for a first embodiment, firstly the outputs according to the time of the programming signals applied to each of the coils as well as different locations of the projectile according to time.

FIG. 5 shows the mode of operation of a device according to this first embodiment.

Four configurations A, B, C and D of the device are shown in the upper part of the Figure, when a projectile 8 passes successively in front of the different coils 2*a* to 2*g*.

The low part of the Figure shows the eight temporal diagrams of the signals corresponding, respectively from top to bottom, to that $S_{10}$ received by the position sensor 10 and to those $S_{2a}$ to $S_{2g}$ emitted by coils 2*a* to 2*g*.

All the temporal diagrams are shown temporally synchronized. The same is true for the four configurations A, B, C and D of the device 1 which are positioned opposite their temporal location with respect to the diagrams. Each diagram shows the inactive coils 2*i* in white and the coils that are emitting at their maximal output in grey-bold.

Configuration A shows a projectile 8 arranged substantially between coils 2*a* and 2*b*. The previous projectile 8*a* leaves the feed star wheel 7. The sensor 10 detected the appearance of the projectile 8 a few milliseconds previously (Signal $S_{10}$). This configuration A corresponds to the start of the emission at maximal output of the two coils 2*a* and 2*b*. This occurs, therefore, at the instant the emission starts $T_{0a}$ and $T_{0b}$ for these two coils.

Configuration B corresponds to that of the device when the projectile 8 is opposite the third coil 2*c*. This configuration occurs at an instant that is the start of emission $T_{0d}$ for a fourth coil 2*d* and the end of emission $T_{1a}$ for the first coil 2*a*. In this configuration only three of the coils, 2*b*, 2*c* and 2*d* are emitting.

Configuration C corresponds to that of the device when the projectile 8 is opposite the fifth coil 2*e*. This configuration occurs at an instant which is the start of emission $T_{0f}$ for the sixth coil 2*f* and the end of emission $T_{1c}$ for the third coil 2*c*. In this configuration only three of the coils, 2*d*, 2*e* and 2*f*, are emitting.

Lastly, configuration D corresponds to that of the device when the projectile 8 is opposite the seventh and last coil 2*g*. This configuration occurs at an instant which is the end of emission $T_{1e}$ for the fifth coil 2*e*. In this configuration, only the last two coils, 2*f* and 2*g*, are emitting.

The following projectile 8*b* then approaches the position sensor 10 and a new detection signal $S_{10}$ will appear. The trailing edge of this signal $S_{10}$ will both activate the end of emission for the two coils 2*f* and 2*g* and the start of emission for the two coils 2*a* and 2*b*. This instant is thus both the end of emission $T_{1f}$ and $T_{1g}$ for coils 2*f* and 2*g* and the start of emission $T_{0a}$ and $T_{0b}$ for coils 2*a* and 2*b*. The power cycle for the coils continues thereafter with the same temporal spacing as for the different levels of power for the projectile 8*b*.

Naturally, the content of the programming signals is not given here and may classically be different from one projectile to another depending on operational requirements dictated by the weapon's firing control.

What is repeated in accordance with the invention is the successive temporal spacing of the different levels of power of the coils 2*i* during the passage of a projectile 8 in front of them.

The different vertical dotted lines shown on the diagram are spaced from one another by an increment $\delta T$ that is of around a twenty or so milliseconds for a feed star wheel with a caliber of 25 mm.

Taking the temporal diagrams into account, we note that there are never more than 3 coils 2*i* functioning simultaneously and that only two coils function during the first and the last lapses $\delta T$.

This results in a maximal output that is only 42.8% of the maximal output required when all the coils are activated. This also results in an overall electrical energy consumption over the cycle that is only 38.8% of the electrical consumption of devices according to prior art in which all the coils are activated simultaneously.

Such a saving is highly appreciable in onboard weapon systems for which energy consumption and the overall dimensions of the power electronics are sought to be minimized. Furthermore, we note that programming interference from one projectile to another is minimized since only the end coils 2*f* and 2*g* are powered when the following projectile 8*b* approaches the device.

According to a second embodiment of the invention, each coil 2*i* will emit a continuous signal that gradually increases in power between emission start instant $T_0$ and a median instant $T_M$ and will then decrease between the median instant $T_M$ and the emission end instant $T_1$.

The variation in power output will be obtained by giving each control signal σi of each amplification stage 14*i* an amplitude that varies according to the progress of the projectile with respect to a given coil.

Figure 6:
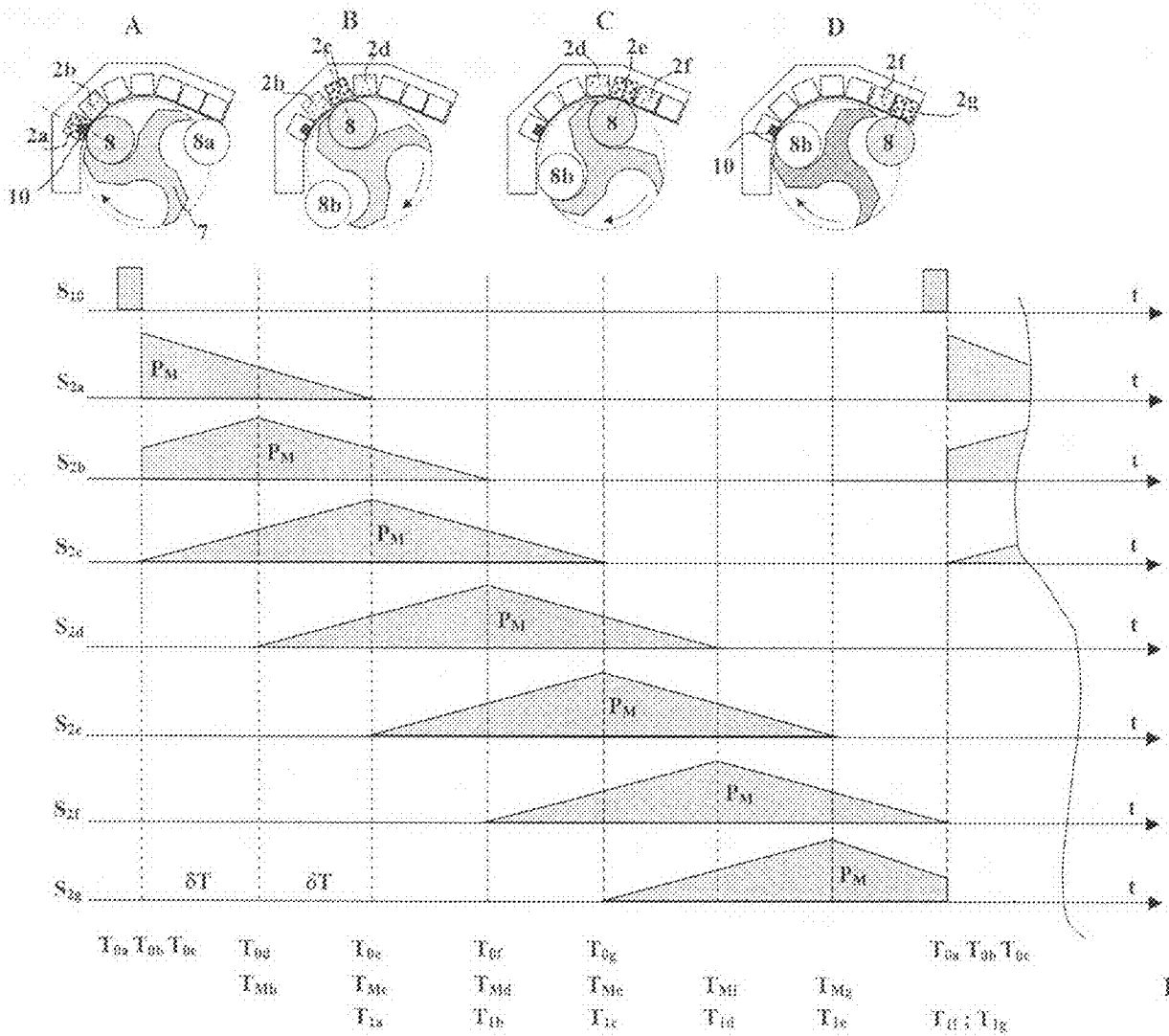
FIG. 6 is a diagram that is analogous to that in FIG. 5 but for a second embodiment of the invention.

FIG. 6 shows the operating mode of a device according to this second embodiment.

As previously, the upper part of the Figure shows four configurations A, B, C and D of the device when a projectile 8 passes successively in front of the different coils 2*a* to 2*g*.

The lower part of the Figure once again shows the eight temporal diagrams for the corresponding signals, respectively from top to bottom, to that $S_{10}$ received by the position sensor 10 and those $S_{2a}$ to $S_{2g}$ emitted by coils 2*a* to 2*g*.

All the temporal diagrams are shown temporally synchronized and the same is true for the four configurations A, B, C and D of the device 1 that are positioned opposite their temporal location with respect to the diagrams.

In each diagram, the inactive coils 2*i* are shown in white. Since the signals emitted by the coils are variable in output, the coil that is emitting at its maximal output is shown in grey-bold and those which are not emitting at their maximal output are shown in pale grey.

We can see that the outputs emitted by each coil generally follow a triangular profile. This is true for signals $S_{2c}$, $S_{2d}$, $S_{2e}$ and $S_{2f}$. The cycle start and end signals have a slightly different profile in which the triangles of signals $S_{2a}$, $S_{2b}$ and $S_{2g}$ are slightly truncated.

The emitted output thus increases (except for signal $S_{2a}$) linearly from the start of emission $T_0$ to a median instant $T_M$ and then linearly decreases between this median instant $T_M$ and end of emission instant $T_1$.

For the full triangles (signals $S_{2c}$, $S_{2d}$, $S_{2e}$ and $S_{2f}$) two elementary time lapses δT separate a start of emission at nil output $T_0$ and an emission at maximal output $T_M$. Two other elementary times lapses δT then separate the instant $T_M$ at maximal output and the end of emission $T_1$.

The output variation slopes are the same for the leading and trailing edge (the triangles are isosceles triangles with a height of $P_M$ and a base of 4 δT).

Configuration A shows a projectile 8 arranged substantially between coils 2*a* and 2*b*. The previous projectile 8*a* leaves the feed star 7. The sensor 10 detected, a few milliseconds previously (signal $S_{10}$) the appearance of the projectile 8.

This configuration A corresponds to the start of emission $T_{0a}$, $T_{0b}$ and $T_{0c}$ for the first three coils. However, the first coil 2*a* emits in this case at its maximal output $P_M$, the second coil 2*b* emits at an intermediate output equal to half the maximal output $P_M$ and the third coil 2*c* starts emitting from a nil output.

Configuration B corresponds to that at which a third coil 2*c* emits at its maximal output $P_M$ (grey-bold in the Figure) whereas coils 2*b* and 2*d* framing it emits at half the output $P_M/2$ (pale grey in the Figure). This configuration appears at an instant which is both the instant $T_{Mc}$ for coil 2*c*, emission end instant $T_{1a}$ for coil 2*a* and emission start instant $T_{0e}$ for coil 2*e*.

Configuration C corresponds to that in which the fifth coil 2*e* emits at its maximal output $P_M$ whereas coils 2*d* and 2*f* framing it emits at half output $P_M/2$. This configuration appears at an instant that is both $T_{Me}$ for coil 2*e*, emission end instant $T_{1c}$ for coil 2*c* and emission start instant $T_{0g}$ for coil 2*g*.

Configuration D lastly corresponds to that in which the seventh coil 2*g* emits at its maximal output $P_M$ whereas only the preceding coil 2*f* emits at half output $P_M/2$. This configuration appears at an instant that is both $T_{Mg}$ for coil 2*g*, emission end instant $T_{1e}$ for coil 2*e*.

After another time lapse δT, the leading edge of the signal S10 appears from the sensor 10 after detection of a new projectile 8*b*. This detection causes the seventh coil to stop emitting at half output and thus corresponds to both instants $T_{1g}$ and $T_{1f}$.

The trailing edge of signal S10 will, furthermore, activate the start of emission for coils 2*a*, 2*b* and 2*c*, at the output levels described previously (maximal output for coil 2*a*, half-output for coil 2*b* and nil output for coil 2*c*). This instant is thus also the emission start instant $T_{0a}$, $T_{0b}$, and $T_{0e}$.

The power cycle of the coils continues with the same temporal spacing as the levels of output for projectile 8*b*.

By observing the temporal diagrams, we note that there are never more than four coils 2*i* functioning simultaneously at any time and that these have different power outputs and that only three coils function during the first time lapse and two coils during the second time lapse.

Given the symmetries of the leading and trailing edges of the variations in output, this results in a maximal output that is only 28.6% of the maximal power output required when all the coils are activated. This also results in an overall electrical energy consumption over the cycle that is only 24.5% of the energy consumption of devices according to prior art in which all the coils are activated simultaneously.

This embodiment is thus even more economical than the previous one. Furthermore, it enables the radiation of the programming signal to be limited to a single zone in which the projectile is located.

As explained previously, it is possible for a device to be defined in which the progress rate of the projectile is not a pre-programmed fixed value but a variable value that is measured in real time.

Such a solution is particularly useful in certain weapon systems for which the spin rate of the feed star does not have a fixed value For this, means may be implemented to measure the rate 13 (FIG. 4), for example a sensor measuring the spin rate ω of the star 7.

According to another embodiment of the invention, the progress rate of the projectile can be simply determined by providing at least a second position sensor 10 incorporated in another coil. The spaces (λi) between the different sensors 10*i* are known since this is part of the construction data.

Measurements of the time taken to pass in front of the two successive sensors ($\mathbf{10}_{i-1}$, $\mathbf{10}_i$) thus enables the passage rate to be easily determined ($Vi=\lambda i/(T_i-T_{(i-1)})$).

Figure 7:
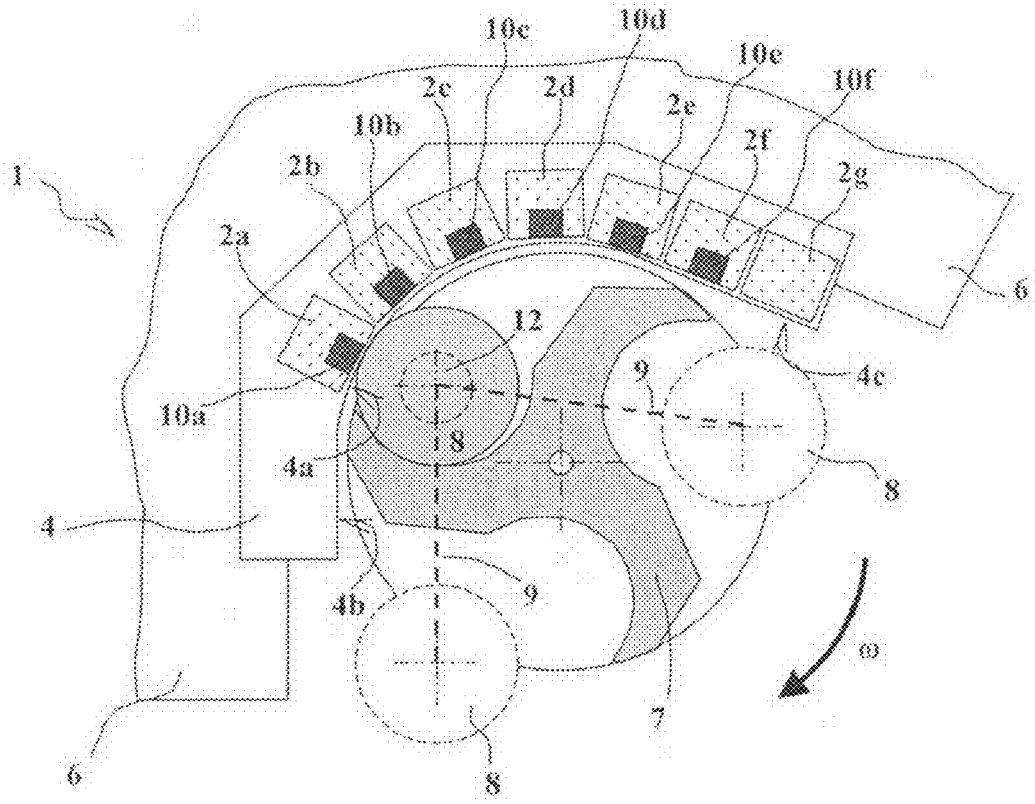
FIG. 7 shows a programming device according to one variant of the invention.

FIG. 7 thus shows six position sensors 10*a*, 10*b*, 10*c*, 10*d*, 10*e* and 10*f* each incorporated into one of coils 2*a* to 2*f*. These position sensors will all be linked to electronic control means 3. The latter will thus incorporate an additional algorithm enabling the passage rate of projectile 8 to be deduced via the detection of the instant of passage of this projectile in front of two successive sensors 10*i*.

Two successive sensors enable the passage rate of the projectile in front of the coil immediately following the second sensor to be measured. By arranging six sensors 10*i*, as shown in FIG. 7, the projectile is accurately located with respect to each coil.

Furthermore, as here, by using one less sensor than there are coils, the projectile may simply be located with respect to the coils (with no calculation of progress rate), the detection of the passage of the projectile by a sensor 10*i* in fact necessarily implying the positioning of the projectile at a given distance from the coil immediately following.

Such an embodiment of the invention enables abstraction to be made of the definition of the weapon system (within the limits of assembly constraints). It is thus no longer necessary to have speed sensors, the programming means also ensuring the location of the fuse with respect to the coils or to the measurement of the progress rate.

Different variants are possible without departing from the scope of the invention.

Figure 8:
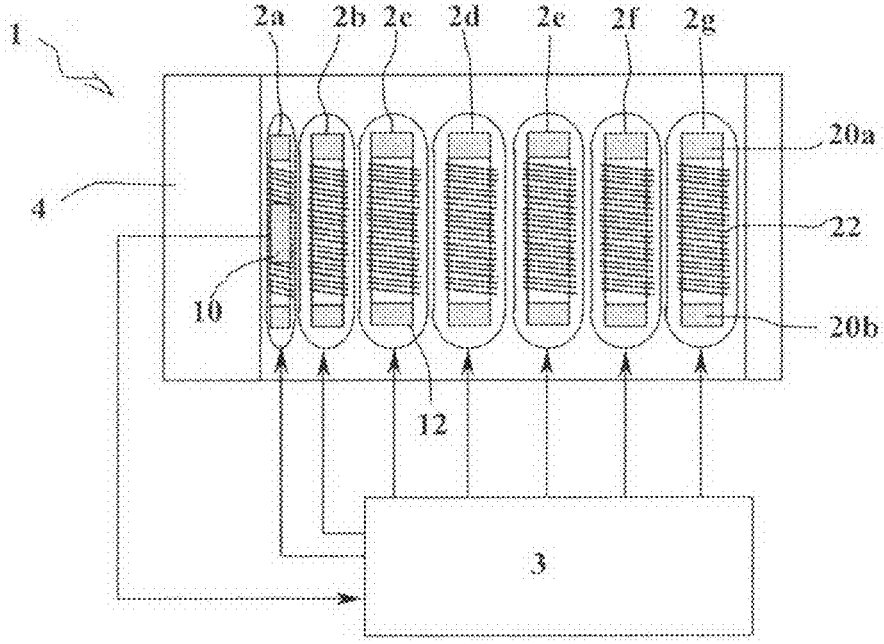
FIG. 8 is an analogous view to FIG. 2 but implementing another type of coil.
Figure 10:
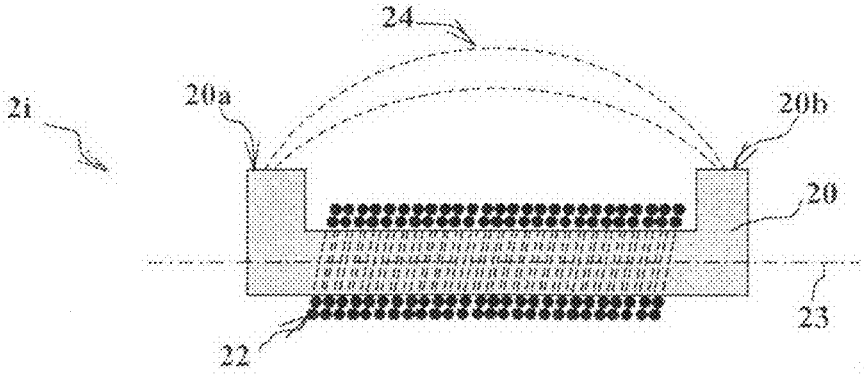
FIG. 10 is a view schematizing another embodiment of a coil implemented by the invention.

FIG. 8 schematizes an embodiment whose functioning is identical to that described previously but in which the coils 2*i* have a different structure that is more precisely detailed in FIG. 10. These coils incorporate a U-shaped core of ferrite 20, which thus incorporates two end poles 20*a* and 20*b*. The loops 22 of the coil are wound around the median part of the ferrite 20. Thus, the loops here are perpendicular to the projectile axis, axis 23 of the coil is, however, parallel to the projectile axis. Because of the U-shape of the ferrite, the lines 24 of the magnetic field which are generated extend from pole 20*a* to pole 20*b* and are thus effectively directed towards the fuse 12 of the projectile.

The advantage of such an embodiment lies in that these coils are standard components that are easily available commercially.

Other embodiments may be foreseen.

Thus, here a programming device is described that is arranged on a feed star, thus for which the coils 2*i* are arranged on a cylindrical portion of the projectile's supply device.

It is naturally possible for a device to be defined according to the invention in which the programming is made in a rectilinear channel in which the coils follow one another in parallel.

Furthermore, since each programming coil can be individually programmed, a device may be defined in which a different programming signal can be applied at the feed channel exit and at the entrance to said channel. It thus becomes possible for feed devices to be defined in which the coils are spaced over greater distances and are able to programme several fuses simultaneously with different programming signals.

In certain configurations, each elementary coil 2*i* that is at a given instant opposite the projectile fuse can be replaced by two or several coils that will be supplied simultaneously by the same signals. These coils, which are thus simultaneously opposite the projectile fuse at a given moment, are equivalent to one-and-the-same coil within the meaning of the present invention.

For example, in the case of a rectilinear channel and so as to increase the transfer of energy, each individual coil 2*i* can be replaced by two coils arranged opposite one another on one wall of the channel. The projectile will thus pass between these two coils. These two coils will be powered simultaneously by the control means and are the equivalent of one-and-the-same coil within the meaning of the present invention. The fuse will thus, during its progress through the channel, be successively opposite several pairs of coils and each pair of coils will be powered by the electronic control means as would one-and-the-same coil in accordance with the process previously described.

What is claimed is:

1. A programming device for programming a fuse of a projectile when the projectile passes in a feeder of a weapon, the programming device comprising: at least two programming coils each linked individually to an electronic controller, the coils arranged so as to be able to lie in proximity to the fuse when the projectile passes through the feeder of the weapon, the coils being arranged such that the fuse passes successively in front of each of the coils.

2. A programming device according to claim 1, further comprising a device enabling the position of the fuse to be determined with respect to the coils as the projectile progresses.

3. A programming device according to claim 2, wherein the device enabling the position of the fuse to be determined with respect to the coils comprises at least one position sensor coupled with the electronic controller.

4. A programming device according to claim 3 wherein the position sensor is also coupled with a device to determine the progression rate of the projectile.

5. A programming device according to claim 4 wherein the coils are arranged at a cylindrical surface of the weapon surrounding a feed star wheel, the rate of progression being determined by the spin rate (w) of the feed star wheel.

6. A programming device according to claim 3, wherein the device enabling the position of the fuse to be determined comprises a second position sensor linked to the electronic controller.

7. A programming device according to claim 4, wherein the device to determine the progression rate of the projectile comprises a second position sensor linked to the electronic controller.

* * * * *